US005996265A

United States Patent [19]

Coury

[11] Patent Number: 5,996,265

[45] **Date of Patent: *Dec. 7, 1999**

[54] DISPOSABLE WEAPON SYSTEM

[75] Inventor: William S. Coury, Sarasota, Fla.

[73] Assignee: Delta Defense, Inc., Arlington, Va.

[ * ] Notice: This patent is subject to a terminal disclaimer.

[21] Appl. No.: 08/952,546

[22] PCT Filed: May 25, 1995

[86] PCT No.: PCT/US95/06497

§ 371 Date: Apr. 6, 1998

§ 102(e) Date: Apr. 6, 1998

[87] PCT Pub. No.: WO96/37748

PCT Pub. Date: Nov. 28, 1996

[51] Int. Cl.[6] ..... F41A 3/00; F41C 3/14

[52] U.S. Cl. ..... 42/39.5; 42/59

[58] Field of Search ..... 42/39.5

[56] References Cited

U.S. PATENT DOCUMENTS

| | | | |
|---|---|---|---|
| H61 | 5/1986 | Yuhash et al. | 42/39.5 |
| 75,016 | 3/1868 | Holman . | |
| 3,765,116 | 10/1973 | Zaid | 42/89 |
| 3,797,153 | 3/1974 | Hagan | 42/27 |
| 4,156,981 | 6/1979 | Lusk | 42/63 |
| 4,455,777 | 6/1984 | Callies | 42/59 |
| 5,067,408 | 11/1991 | Martwick | 102/434 |
| 5,295,320 | 3/1994 | Svensson | 42/49.01 |
| 5,416,999 | 5/1995 | Coury | 42/59 |
| 5,784,821 | 7/1998 | Gerard | 42/39.5 |

FOREIGN PATENT DOCUMENTS

| | | | |
|---|---|---|---|
| 927940 | 11/1947 | France | 42/39.5 |
| 1036294 | 9/1953 | France | 42/39.5 |
| 527942 | 4/1954 | France | 42/39.5 |
| 1206716 | 2/1960 | France . | |
| 1099906 | 2/1961 | Germany | 42/39.5 |
| 834691 | 5/1960 | United Kingdom | 42/39.5 |

*Primary Examiner*—Charles T. Jordan
*Assistant Examiner*—Denise J Buckley
*Attorney, Agent, or Firm*—Needle & Rosenberg, P.C.

[57] ABSTRACT

A disposable weapon system includes at least one ammunition round having a projectile, a propellant charge, and a casing strong enough to withstand the firing forces of the ammunition round containing the propellant charge and for securing and sealing the projectile. The disposable weapon system also includes a device for igniting the propellant charge of the ammunition round and a stick magazine having at least one through-bore complementary to and surrounding the casing of the ammunition round. The disposable weapon system further includes a barrel forward of the magazine that has a front end, a rear end adjacent to the magazine, and an inside surface forming a central bore aligned with the ammunition round within the magazine. The central bore forms a pressure tight seal with the magazine to allow the projectile of the ammunition round to traverse the central bore and exit the front end of the barrel.

16 Claims, 7 Drawing Sheets

DISPOSABLE WEAPON SYSTEM

BACKGROUND OF THE INVENTION

1. Field of the Invention

This invention relates to a lightweight, shoulder-fired, flat-trajectory, disposable weapon system. In particular, this invention relates to a disposable weapon system for shooting multiple ammunition rounds from a stick magazine capable of penetrating armor personnel carriers (APC), wherein the weapon system is designed to minimize weight, cost, and maximize safety.

2. Background Art

Military operations have demonstrated the need for a weapon, to be used by infantry troops, capable of incapacitating armored vehicles This task however, has proven to be difficult. The weapons currently available to infantry forces lack the capability to damage such vehicles.

To illustrate the difficulty in destroying armored vehicles, an example is helpful. Some APCs are constructed of approximately two inches of rolled homogenous armor (RHA) and are capable of traveling at speeds of approximately 35 miles per hour. These two factors, coupled with the distance that a soldier is positioned away from the vehicle when firing his weapon, make the APC almost immune from small platoon attacks Some weapons do exist that are capable of penetrating the two inches of metal shielding an APC. However, many of these weapons lack a flat-trajectory projectile path, thus making the likelihood of hitting the target extremely small. In other words, a remote probability exists that a weapon will hit a target moving up to 35 miles per hour at a distance of over 200 meters using a "lob" trajectory path Additionally, the existing weapon systems with the same capabilities as the present invention are fired "over the shoulder" or from a platform. One reason for this type of firing method is that the weapons are bulky and heavy, which also negates the feasibility of use by infantry force. Also, these weapons are fired from a position other than against a soldier's shoulder because the resulting back-blast could injure the weapon user. Futhermore, this back-blast make firing these weapons impracticable in closed spaces and extremely dangerous to fire forward of other soldiers or supplies.

The existing weapons are also expensive. The weapons are designed to withstand a large number of firings, possibly 10,000 rounds or more. The materials, therefore, must be manufactured to endure the peak stress and the average stresses of every firing withstand the cyclic loading for each firing. As a result, the engineering design not only increases the cost of these weapons but also creates an unwieldy weapon for infantry troops.

SUMMARY OF THE INVENTION

The presently preferred embodiment of the disposable weapon system comprises at least one ammunition round having a casing which can withstand the firing forces of the ammunition round, a means to fire the ammunition round, a stick magazine and a barrel that aligns with the ammunition round in the magazine through which the projectile travels.

Unlike other armor penetrating weapons, the present invention is fired the same as a conventional rifle. The characteristics that make the weapon system of the present invention similar to a rifle are its shoulder-fired and flat-trajectory aspects. In contrast, the present invention is different from a rifle because it is disposable and designed to minimize weight.

One object of the weapon system of the present invention is that it is shoulder-fired instead of fired "over the shoulders" or from a platform. This difference from the prior art affords the present invention with many advantages. First, the accuracy of the weapon increases. This accuracy improves because the flat-trajectory projectile path and the ease of aiming a shoulder-fired weapon. Next, the safety increases for the weapon user and for others in his vicinity because the weapon system of the present invention contains the firing exhaust instead of having a back-blast.

In addition to being shoulder-fired, another objective of the present invention may be the capability to pierce armor vehicles. The preferred embodiment provides a weapon system that is capable of penetrating approximately one inch or more of RHA. Although the weapon system of the present invention operates similarly to conventional shoulder-fired weapons such as a rifle, the present invention has greater firepower than its rifle counterpart. This increased firepower is possible because the weapon system is non-reusable. After shooting the number of ammunition rounds which the weapon is designed to withstand, then the user disposes of the weapon. By designing a disposable weapon, the stresses that the weapon system must endure are lower, thus allowing the present weapon to fire sufficiently large armor piercing projectiles necessary to penetrate the aforementioned armor.

Other objectives of the present invention involve the minimization of cost and weight and the maximization of safety. It is contemplated that the materials be chosen based upon certain factors. One important consideration is the strength of the material. Another factor is the weight of the material. Also, the cost of the material is an important consideration. Examples of preferable materials include, but are not limited to, titanium alloys, stainless steel carbon graph, polymers, ceramic, and the like. In addition to minimizing cost of materials, the expense of the weapon may be further because it may use the design of parts from other weapons that are common in the art, such as a recoil sensitive rifle butt and a recoil sensitive rifle stock.

The present invention satisfies the need in the art for an armor piercing weapon that infantry troops may fire from all locations, including enclosed areas. In addition to the ability to use the present invention regardless of location with a high degree of accuracy, it may be manufactured from lightweight components that are chosen to be cost effective. The preferred embodiment of the disposable weapon costs approximately $1,000 to $2,000, a modest price in comparison to the approximately $1,000,000 price tag of an APC.

BRIEF DESCRIPTION OF THE DRAWINGS

FIG. 2A is a side longitudinal view and FIG. 2B is a cut-away view of FIG. 2A.

FIG. 3A shows the cylinder without the concave end cap attached, and FIG. 3B shows the concave end cap welded to the cylinder.

DESCRIPTION OF THE PREFERRED EMBODIMENT

Figure 1A:
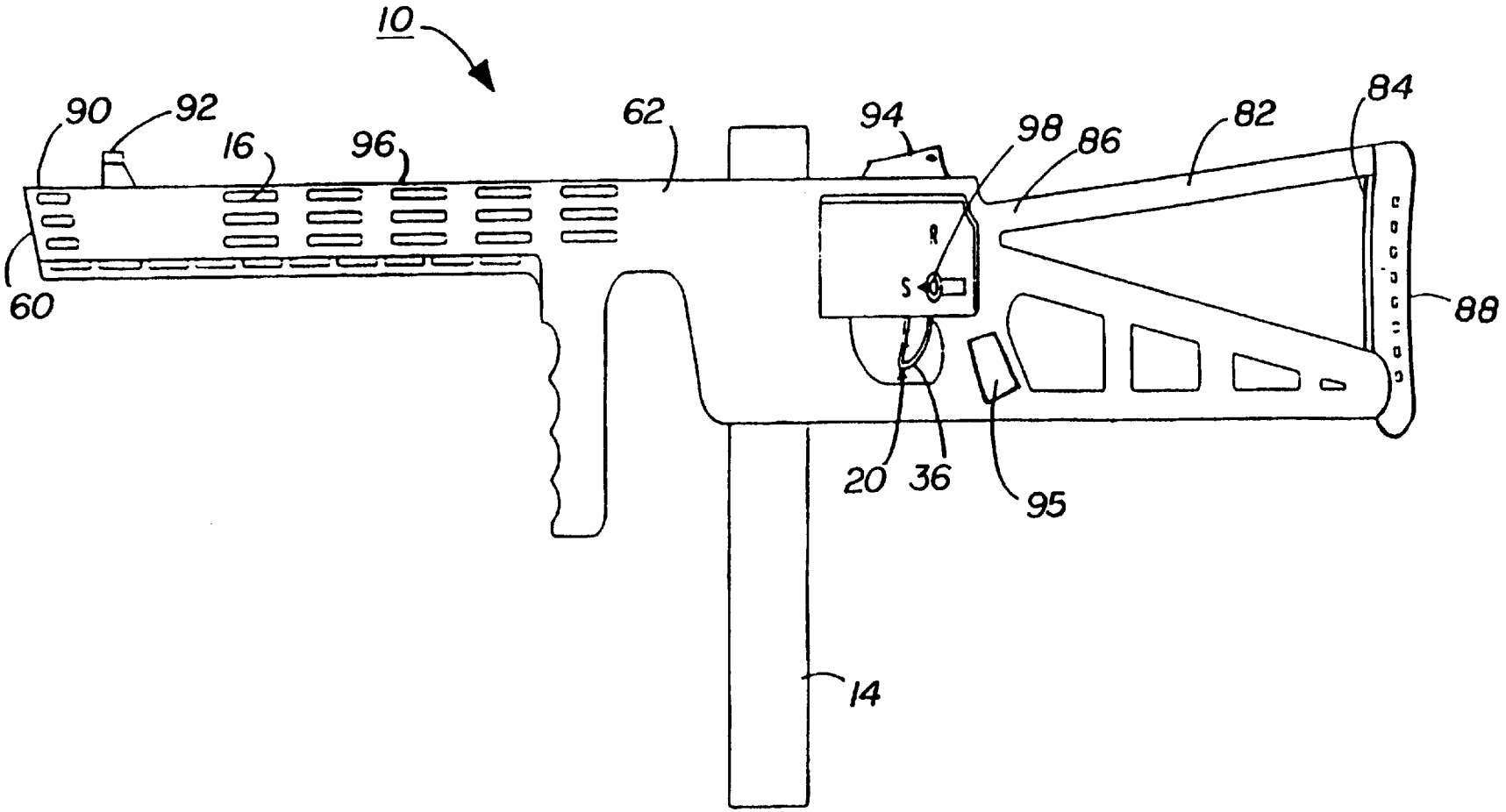
FIG. 1A is a side view of one embodiment showing the weapon system.

The present invention may be understood more readily by reference to the following detailed description of specific embodiment with reference to the Figures in which like numbers refer to like parts throughout the views.

Referring generally to FIGS. 1–6 , the present invention provides a disposable, lightweight, shoulder-fired, flat-trajectory weapon system 10 comprising an ammunition round 12, a means 20 to fire the ammunition round 12, a stick magazine 14, and a barrel 16. The preferred embodiment also encompass a means to accept only a desired number of ammunition rounds 12 to allow a predetermined number of firings of the weapon system 10.

Figure 2A:
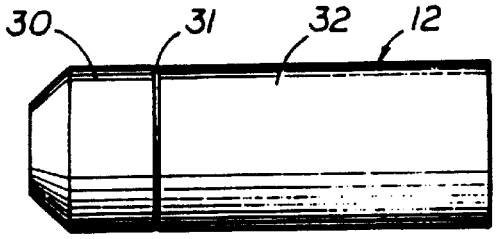
FIGS. 2A and 2B are views of an ammunition round
Figure 2B:
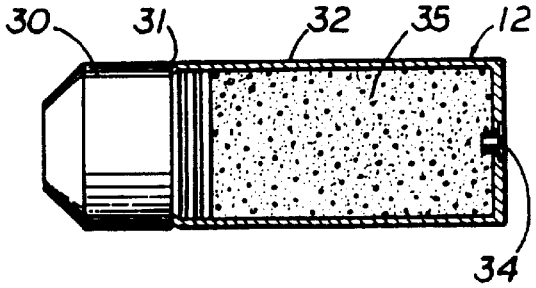

The ammunition round 12, as shown in FIGS. 2A and 2B, comprises a projectile 30 and a casing 32 for containing a propellant charge 35. The juncture of the casing 32 and the projectile 30 maybe sealed with a crimp 31.

The presently preferred embodiment penetrates approximately one inch or more of rolled homogenous armor (RHA). The projectile 30 is a 35 mm explosively formed penetrator. Upon hitting the armored target, the projectile 30 explodes (e.g., high explosive or Monroe effect) and burns through the metal with enough energy to cause behind armor lethality. The projectile 30 can also contain a reduced-size, conventional fuse. Additionally, at 35 mm in diameter, the projectile 30 is small enough to hit a moving armor target at a distance of approximately 250 meters and the target moving at a rate of approximately 35 miles per hour. To hit the above the target, the propellant charge 35 must be sufficient to launch the projectile 30 at high velocity. The propellant charge of the ammunition round 12 in the presently preferred embodiment causes the projectile 30 to exit the front end 60 of the barrel 16 at a velocity of approximately 860 feet per second or more. The casing 32 may be the standard type in the art.

Figure 6:
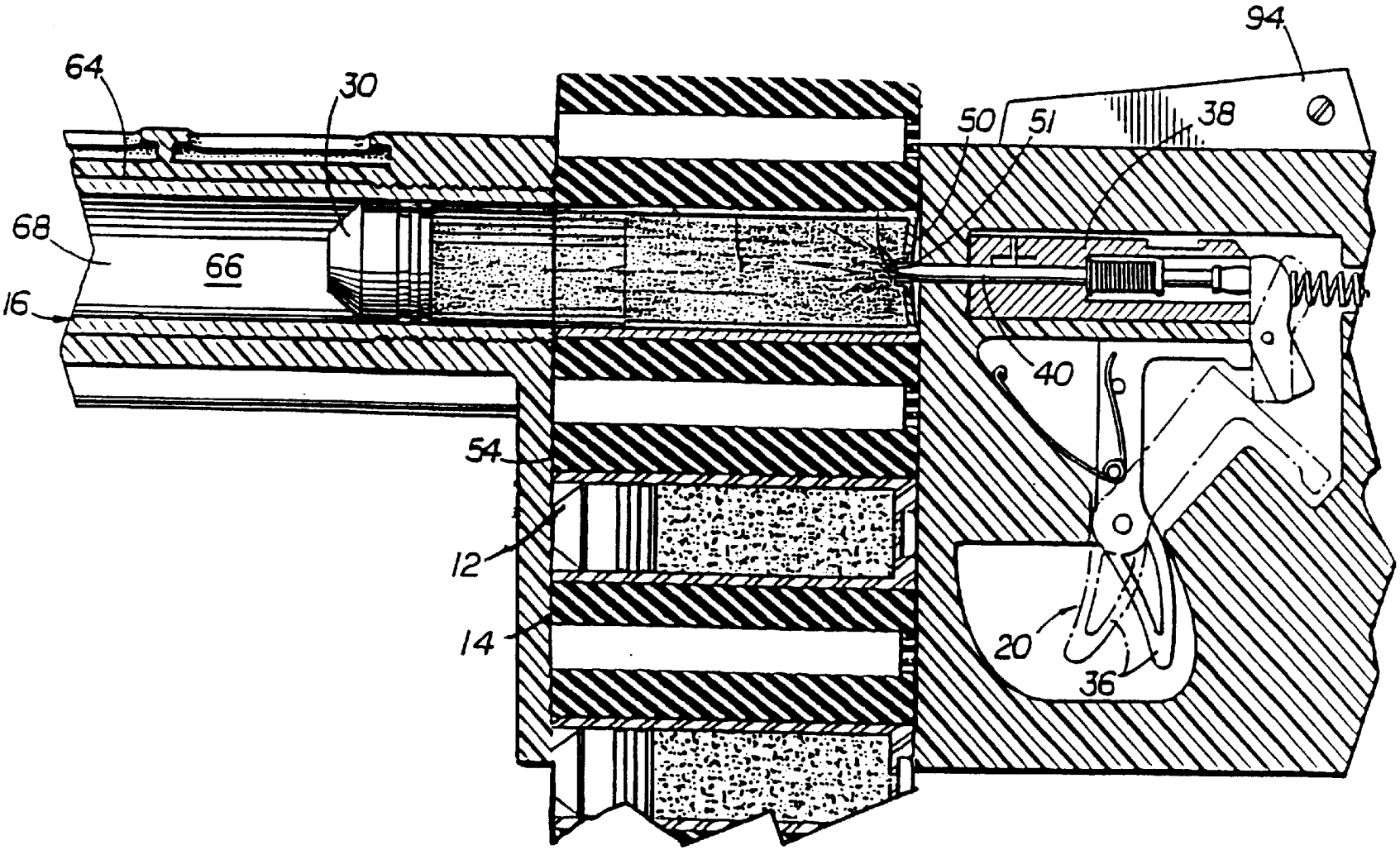
FIG. 6 is a side view of the on system that shows the firing pin striking the ammunition round.

The means 20 for igniting the propellant charge of the ammunition round 12 causes the ammunition round 12 to fire. As shown in FIG. 1B and FIG. 6, the igniting means 20 may comprise a trigger mechanism 36 causing the propellant charge 35 to rapidly inflame, forcing the projectile 30 from the ammunition round 12 and then into and through the barrel 16. The trigger mechanism 36 may be a bolt 38 and firing pin mechanism 40. The firing pin 40 traverses the hole 51 in the concave end cap 50 of the cylinder 18 and strikes the casing 32 of the ammunition round 12. As FIG. 6 illustrates, the firing pin 40 then impacts an ignition device 34 win the ammunition round 12. The presently preferred embodiment of the ignition device 34 is a primer which is common in the art. The mechanical agitation of the ignition ice 34 causes the propellant charge 35 to ignite. The propellant charge 35 then would start a rapid exothermic reaction that rapidly increases the pressure within the ammunition round 12, forcing the projectile 30 from the casing 32 and through the barrel 16. In an alternative embodiment not shown, the trigger mechanism 36 may be an electronic triggering device which is known in the prior art.

Figure 3A:
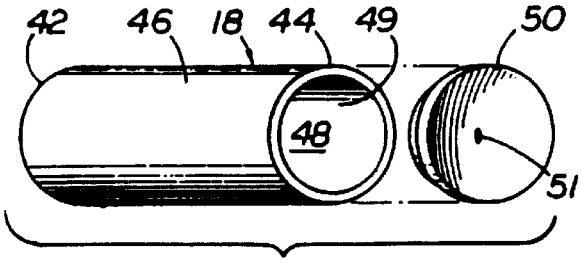
FIGS. 3A and 3B are prespective views of the cylinder of the invention.
Figure 3:
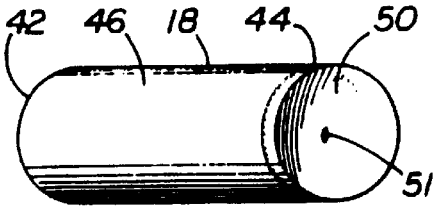

Referring now to FIGS. 3A and 3B, the cylinder 18 has a first end 42, a second end 44, an external sure 46, and an inner surface 48. The inner surface 48 forms an inner volume 49 complementary in size to and capable of slidably receiving the ammunition round 12 therein. A concave end cap 50, which is designed to best handle the explosive pressures and stresses, attachs to the second end 44 of the cylinder 18 so as to form a pressure tight seal strong enough to withstand the firing forces of the ammunition round 12. The concave end cap 50 is constructed with a hole 51 in its center to facilitate the operation of the firing pin mechanism 40 of the igniting means 20. The preferred cylinder 18 and the attached concave end cap 50 are constructed of high-strength alloys capable of withstanding approximately 6,400 psi average pressure and approximately 15,000 psi peak pressure. For example, the high-strength alloy may be a titanium alloy. Using a titanium alloy, the cylinder 18 and the attached concave end cap 50 satisfy the pressure requirements with a minimum factor of safety of approximately 2.0.

In another, preferred embodiment, the casing 32 of the ammunition round 12 may be designed and constructed with enough strength to withstand the firing forces of the ammunition round 12, which may reach 15,000 psi peak pressure and 6,400 psi average pressure. To withstand this stress loading, a material such as a titanium alloy may be used to construct the casing 32. Here, the cylinder 18 is not necessary; instead, the ammunition round 12 directly contacts the magazine 14. Thus, once the ammunition round 12 is fired, the casing 32 can be ejected from the stick magazine 14 to lighten the weight of the weapon system 10 and to allow a clearer view through the sights 92,94.

Figure 4:
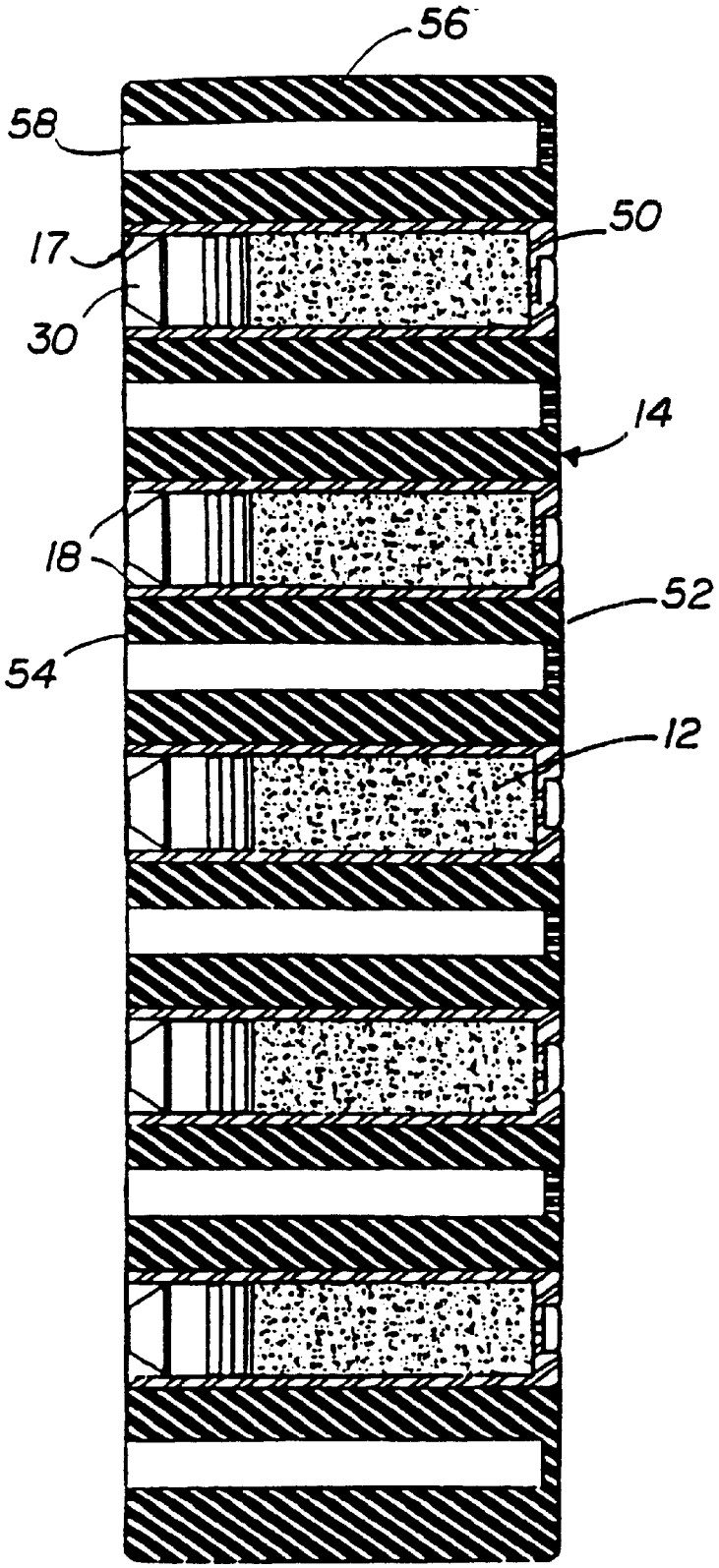
FIG. 4 is a side cross-section view of a stick magazine.

Referring now to FIG. 4, the stick magazine 14 has a plurality of through-bores 17 complementary to and surrounding a plurality of the cylinders 18 and the associated concave end caps 50 designed for holding the ammunition rounds 12 Alternatively, the cylinders 18 can be omitted and the firing stress contained by either the casing 32 of the ammunition round 12 or the magazine 14. The magazine 14 shown in FIG. 4 allows multiple firings of ammunition rounds 12 from the weapon system 10, but the magazine 14 can be designed to allow only a single ammunition round 12 to be fired. The number of ammunition rounds 12 in a magazine 14 may range from one to eight or more. In the presently preferred embodiment, the magazine 14 comprises a stick-type container having an aft flat exterior side 52, a forward flat exterior side 54, and a middle flat exterior side 56. The projectile 30 remains unobstructed by the forward flat exterior side 54, thus providing a clear path to the central bore 68 of the barrel 16. The magazine 14 may consist of lightweight, inexpensive, moldable material. For example, the magazine 14 may consist of carbon graphics, or, for another example, ceramic material.

In an alternative embodiment, the magazine 14 may be constructed of materials sufficient in strength to withstand the firing force of the ammunition round 12. For example, the material may be a strong ceramic or polymer material or a product yet to be developed In this alternative embodiment, the casing 32 of the ammunition round 12 would no longer need to be designed to withstand the firing pressures since the material comprising the magazine 14 would now withstand these firing stresses.

As shown in FIG. 1B and FIG. 6, the barrel 16 is located forward of the stick magazine 14. The barrel 16 has a front end 60, a rear end 62 adjacent to the magazine 14, an outside surface 64, and an inside surface 66. The inside surface 66 forms a central bore 68 which aligns with one of the cylinders 18 within the magazine 14. The juncture of the barrel 16 and the magazine 14 forms a pressure tight seal The pressure tight seal result because forward flat exterior side 54 of the magazine 14 is machined to adjoin the rear end 62 of the barrel 16 and form a pressure tight seal. This seal allows each projectile 30 of the ammunition round 12 to traverse the central bore 68 and exit the front end 60 of the barrel 16 with its maximum velocity for the propellant charge used In the presently preferred embodiment, the barrel 16 is engineered with a safety factor specifically to withstand the stress loading of firing the ammunition rounds 12 allowed to be fired only and no more rings. The minimum factor of safety is approximately 2.0. The number of ammunition rounds 12 in a magazine 14 may range from two to eight or more.

The weapon system can have a means to advance the ammunition rounds 12 to align each sequential ammunition round 12 with the barrel 16. This advancing means can be a manual physical force exerted by the user to push the magazine 14 upward after the firing of each ammunition round 12 in the magazine 14. Alternatively, the advancing means can be automatic For example, a compressed spring can be located in the bottom of the magazine 14 which can expand only after the firing of the ammunition round 12 which is aligned with the barrel 16. The expansion of the spring occur until the next sequential ammunition round 12 is aligned with the barrel 14. The process repeats itself until all the ammunition rounds 12 have been fired.

Figure 1B:
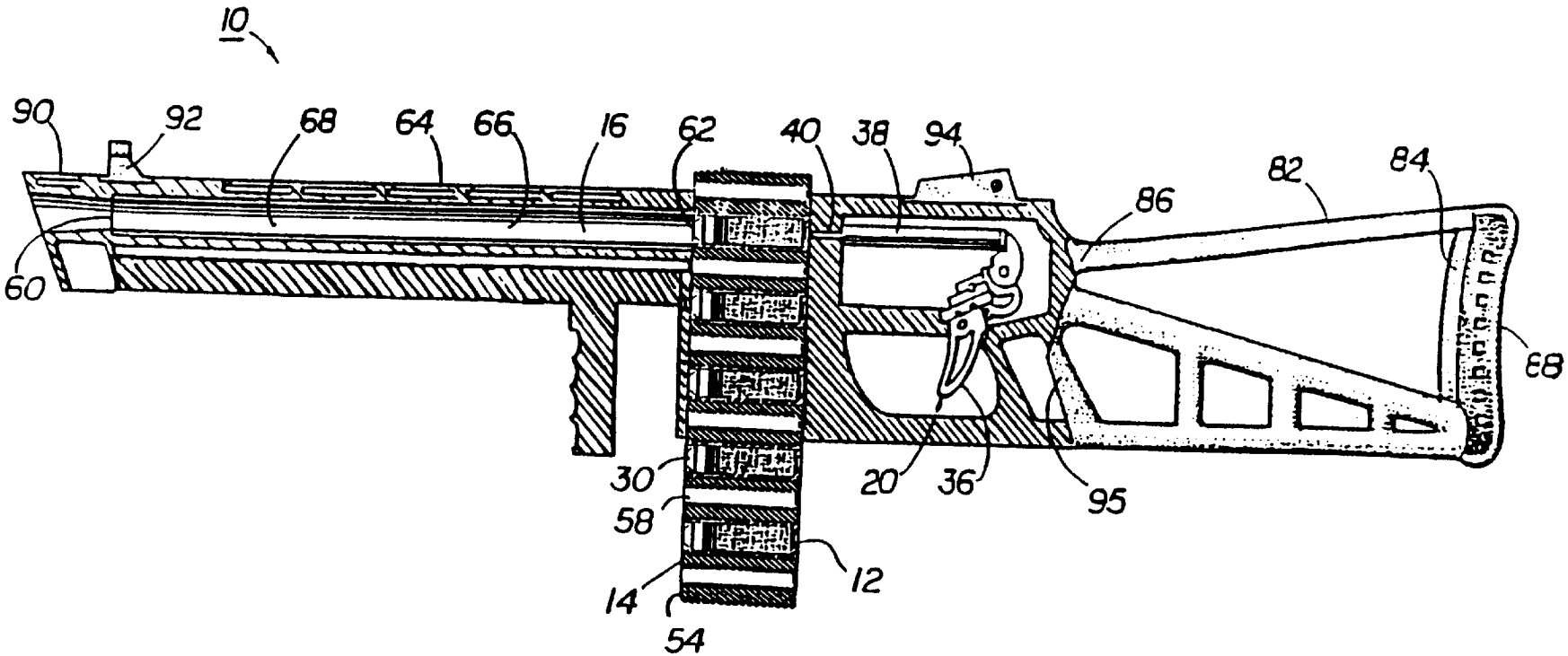
FIG. 1B is the partial- cross-section view of the embodiment of FIG. 1A showing the internal components of the weapon system.

In the stick magazine shown in FIGS. 1A, 1B and 4, a gap 58 exists intermediate each pair of ammunition rounds 12 and at the top of the magazine 14. This gap 58 allows the user to have an unobstructed view from the rear sight 94 to the front sight 92.

Figure 5B:
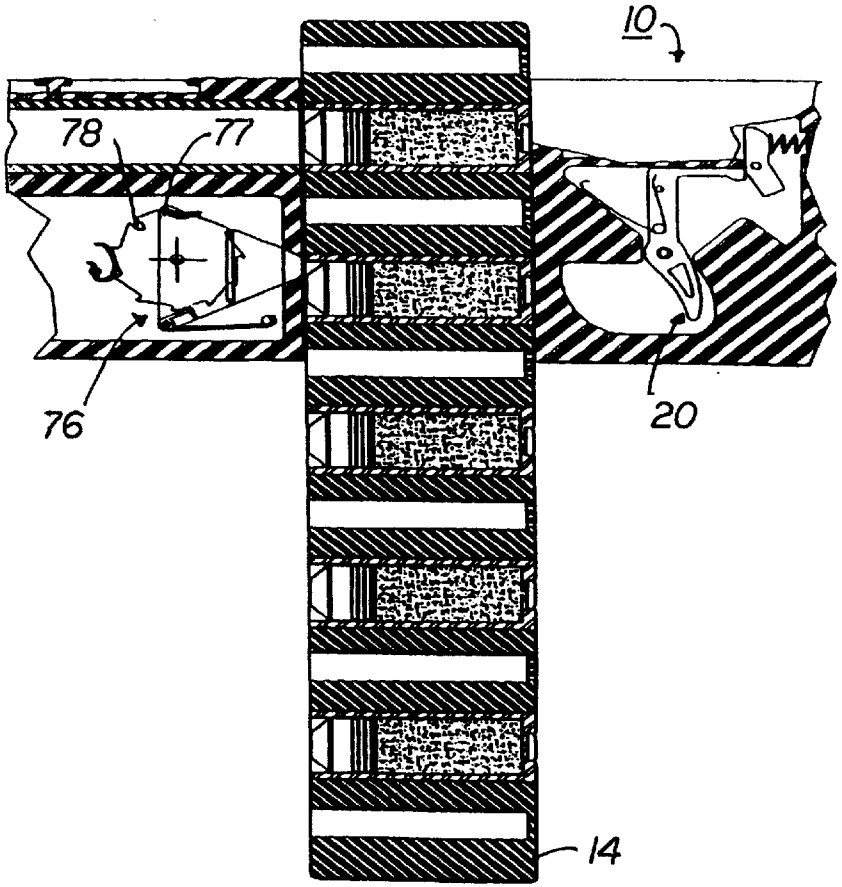
FIGS. 5A, 5B and 5C are side view of one embodiment that shows stick magazines being loaded and a means to limit the number of ammunition rounds that can be loades.
Figure 5A:
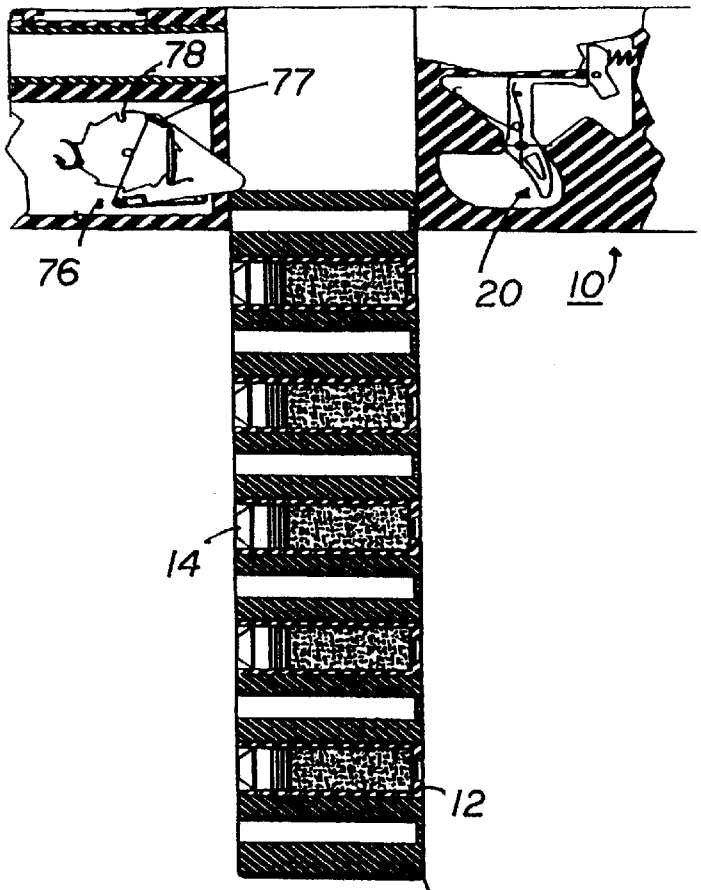
Figure 5C:
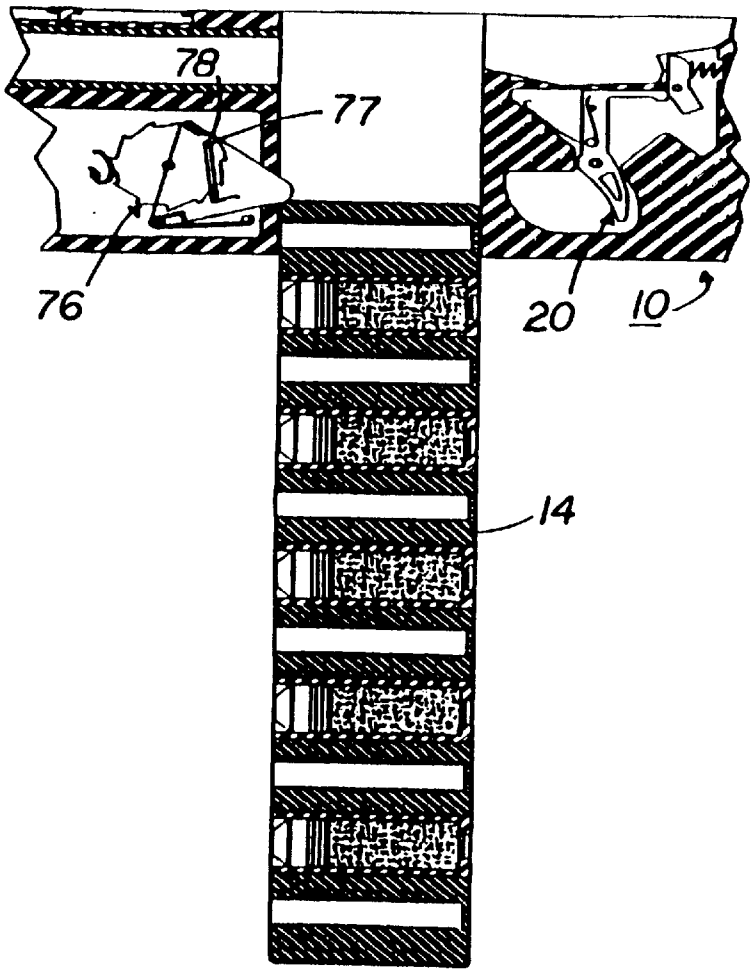

The preferred embodiment also encompasses a means to accept only a desired number of ammunition rounds 12 to allow a predetermined number of firings of the weapon system 10. The weapon system 10 can be designed to accept a single magazine 14 only. In the presently preferred embodiment shown in FIGS. 5A, 5B, and 5C a limiter 76 is included to allowed a desired number of magazines 14 to be accepted by the weapon system 10. FIG. 5A shows a magazine 14 being inserted into the weapon system 10. The limiter 76 is pushed by a limiter pin 77 about a pivot point toward the front of the weapon stem 10 as shown in FIG. 5B. Once all the ammunition rounds 12 in the magazine 14 have been fired, then the magazine 14 is withdrawn. This process can be repeated, and each time the limiter 76 advances After the desired number of magazines 14 have been inserted into the weapon system 10, then the limiter pin 77 catches in the pawl 78. At this point, the limiter 76 will not allow another magazine to be inserted into the weapon system 10, a illustrated in FIG. 5C. Thus, the quantity of ammunition rounds 12 that the weapon system 10 can fire is mechanically limited. Hence, the design of the weapon system 10 can be made for a desires number of firings and no more. Other means known in the art to limit the number of ammunition rounds 12 likewise can be used.

The weapon system 10 may further comprise a means 82 for absorbing the recoil force resulting from firing the ammunition round 12. The recoil force controlling means 82 may comprise a rifle butt 84 having a first end 86 adjacent to both the magazine 14 and the igniting mean 20 and having a second end 88 placed against users shoulder.

In the presently preferred embodiment, the weapon system 10 may further comprise a flash-hinder 90 adjacent to the front end 60 and attached to the outside 64 of the barrel 16, a front sight 92 adjacent to the front end 60 and attached to the outside 64 of the barrel 16, a rear sight 94 adjacent to the back end 62 and attached to the outside 64 of the barrel 16, and a ventilated hand guard 96 surrounding the outside 64 of the barrel 16. Additionally, in the presently preferred embodiment, the weapon system 10 may further comprise a safety 98 for the trigger mechanism 36, and a pistol grip 95 adjacent to the trigger mechanism 36 and the magazine 14.

Although the present invention has been described with reference to specific details of certain embodiments thereof, it is not intended that such details should be regarded as limitations upon the scope of the invention except as and to the extent that they are included in the accompanying claims.

What is claimed is:

1. A disposable weapon system, comprising:

a. at least one ammunition round having a projectile, a propellant charge, and a casing strong enough to withstand the firing forces of said ammunition round containing the propellant charge and for securing and sealing the projectile therein;

b. means for igniting the propellant charge of said ammunition round, thereby firing said ammunition round;

c. a stick magazine having at least one through-bore complementary to and surrounding the casing of said ammunition round; and d. a barrel forward of said magazine, having a front end, a rear end adjacent to said magazine, and an inside surface forming a central bore aligned with said ammunition round within said magazine and forming a pressure tight seal with said magazine so as to allow the projectile of said ammunition round to traverse the central bore and exit the front end of said barrel.

2. The weapon system of claim 1, further comprising means to advance a plurality of said ammunition rounds so as to sequentially align multiple ammunition rounds with said barrel for firing.

3. The weapon system of claim 1, further comprising means for limiting the number of magazines accepted, whereby said weapon system can fire only a preselected number of said ammunition rounds.

4. The weapon system of claim 1, further comprising means for absorbing the recoil force of firing said ammunition round.

5. The weapon system round of claim 1, wherein the casing of said ammunition round consists of a high-strength alloy.

6. The weapon system of claim 5, wherein the high-strength alloy is a titanium alloy.

7. A disposable weapon system, comprising:

a. at least one ammunition round having a projectile, a propellant charge, and a casing for containing the propellant charge and for securing and sealing the projectile therein;

b. means for igniting the propellant charge of said ammunition round, thereby firing each of said ammunition rounds;

c. at least one cylinder having an inner surface forming an inner volume complementary in size to and capable of slidably receiving said ammunition round therein, said cylinder further comprising a concave end cap attached to one end of said cylinder so as to form a pressure tight seal strong enough to withstand the firing forces of said ammunition round;

d. a stick magazine having at least one through-bore complementary to and surrounding said cylinder; and e. a barrel forward of said magazine, having a front end, a rear end adjacent to said magazine, and an inside surface forming a central bore aligned with said cylinder within said magazine and forming a pressure tight seal with said magazine so as to allow the projectile of said ammunition round to traverse the central bore and exit the front end of said barrel.

8. The weapon system of claim 7, further comprising mean to advance a plurality of said ammunition rounds so as to sequentially align multiple ammunition rounds with said barrel for firing.

9. The weapon system of claim 7, further comprising means for limiting the number of magazines accepted, whereby said weapon system can fire only a preselected number of said ammunition rounds.

10. The weapon system of claim 7, wherein said cylinder and said attached concave end cap are high strength alloys capable of withstanding approximately 6400 psi average pressure and approximately 15,000 psi peak pressure.

11. A disposable weapon system, comprising:

a. at least one ammunition round having a projectile, a propellant charge, and a casing for containing the propellant charge and for securing and sealing the projectile therein;

b. means for igniting the propellant charge of said ammunition round, thereby firing said ammunition round;

c. a stick magazine strong enough to withstand the firing forces of said ammunition round having at least one through-bore complementary to and surrounding the casing of said ammunition round from said weapon system; and d. a barrel forward of said magazine, having a front end, a rear end adjacent to said magazine, and an inside surface forming a central bore aligned with said ammunition round and forming a pressure tight seal with said magazine so as to allow the projectile of said ammunition round to traverse the central bore and exit the front end of said barrel.

12. The weapon system of claim 11, further comprising means to advance a plurality of said ammunition rounds so as to sequentially align multiple ammunition rounds with said barrel for firing.

13. The weapon system of claim 11, further comprising means for limiting the number of magazines accepted, whereby said weapon system can fire only a preselected number of said ammunition rounds.

14. The weapons system of claim 11, wherein the magazine consists of a strong light-weight moldable material.

15. The weapon system of claim 14, wherein the material comprises carbon graphics.

16. The weapon system of claim 14, wherein the material comprises ceramic materials.

* * * * *